US007762109B2

(12) United States Patent
Garcia Bobed

(10) Patent No.: US 7,762,109 B2
(45) Date of Patent: Jul. 27, 2010

(54) DRUM FOR LAUNDRY WASHING MACHINES

(75) Inventor: Ismael Garcia Bobed, Saragossa (ES)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 365 days.

(21) Appl. No.: 11/885,323

(22) PCT Filed: Feb. 22, 2006

(86) PCT No.: PCT/EP2006/060172

§ 371 (c)(1),
(2), (4) Date: Aug. 29, 2007

(87) PCT Pub. No.: WO2006/094902

PCT Pub. Date: Sep. 14, 2006

(65) Prior Publication Data

US 2008/0264115 A1 Oct. 30, 2008

(30) Foreign Application Priority Data

Mar. 8, 2005 (ES) ..... 200500605

(51) Int. Cl.
*D06F 37/06* (2006.01)

(52) U.S. Cl. ..... 68/140; 68/24

(58) Field of Classification Search ..... 68/24, 68/140

See application file for complete search history.

(56) References Cited

U.S. PATENT DOCUMENTS 1,472,434 A * 10/1923 Oberg ..... 68/142
2,194,375 A * 3/1940 Zimarik ..... 68/58
2,676,821 A * 4/1954 Reichelderfer ..... 15/250.23
2,816,742 A * 12/1957 Richterkessing et al. .... 366/228
2,882,964 A * 4/1959 Watkin ..... 160/330
2,916,959 A * 12/1959 Bangs et al. ..... 84/97
3,089,327 A 5/1963 Stilwell, Jr.
3,237,317 A * 3/1966 Heubsch, Sr. ..... 34/599
3,500,147 A * 3/1970 Hirschberg ..... 361/293

(Continued)

FOREIGN PATENT DOCUMENTS

DE 30 05 782 * 8/1980

(Continued)

OTHER PUBLICATIONS

WIPE WO 2004/009264 Jan. 2004.*

(Continued)

*Primary Examiner*—Frankie L Stinson
(74) *Attorney, Agent, or Firm*—James E. Howard; Andre Pallapies

(57) ABSTRACT

Front-loading laundry washing machines or the like comprises a cylindrical perforated strip for letting through the water flow, at least one crusher, a rear drum closing disk, and means for joining the disk to the strip in the area of the end of the crusher nearest to the disk. The joining means comprise a rear joining support, a stop opposite the joining support on the other side of the disk, and pressure means which join the stop to the rear joining support, with the disk and part of the end of the crusher lying there between. The stop is concave and its edges are at least in part in contact with the end of the crusher.

16 Claims, 3 Drawing Sheets

U.S. PATENT DOCUMENTS

| | | | | |
|---|---|---|---|---|
| 3,531,954 | A * | 10/1970 | Krupsky | 68/18 F |
| 7,192,232 | B2 * | 3/2007 | Esser | 411/161 |
| 2005/0160772 | A1 * | 7/2005 | Bobed | 68/140 |

FOREIGN PATENT DOCUMENTS

| | | | |
|---|---|---|---|
| DE | 37 43 657 | | 7/1989 |
| EP | 1 408 149 | | 4/2004 |
| EP | 1 505 188 | | 2/2005 |
| EP | 1 568 812 | | 8/2005 |
| ES | 2 014 838 | * | 7/1990 |
| GB | 1 544 645 | | 4/1979 |
| GB | 2 043 707 | * | 10/1980 |
| SU | 1660827 | * | 7/1991 |

OTHER PUBLICATIONS

Europan Patent Office 0 771 540 May 1997.*
International Search Report PCT/EP2006/060172.

* cited by examiner

DRUM FOR LAUNDRY WASHING MACHINES

TECHNICAL FIELD OF THE INVENTION

The invention relates to the technical field of drums for front-loading laundry washing machines or the like comprising a cylindrical perforated strip for letting through the water flow with at least one paddle, a rear drum closing disk, and means for joining the disk to the strip in the area of the end of the paddle nearest to the disk, the joining means comprising a rear joining support, a stop located opposite the joining support on the other side of the disk, and a pressure means which joins the stop to the rear joining support, with the disk and part of the end of the paddle being located between same.

BACKGROUND OF THE INVENTION

The front-loading washing machines in the prior art such as that in the patent specification ES448939 have a perforated washing machine drum with a rear disk which closes it and a front ring which is used for the aperture for the introduction of the laundry to be washed.

This drum is located in the interior of the detergent solution tank which is filled with water and, in the interior of this detergent solution tank, the drum is rotated with the aid of a motor which drives a shaft force-fitted to the drum. The strip forming the drum has apertures scattered on its surface so that the water can move in and out during the wash cycle.

For the purposes of enhancing the washing performance, the strip forming the drum has deformations which beat the laundry in the course of the rotation during the washing and free it from the internal surface of the strip. These folds are known as paddles.

In the manufacture of drums of this type, the joining of the strip to the rear disk and to the front ring is brought about by the clamping of the metal sheets with the aid of folds.

In the area of the paddles, no clamping is achievable as in the rest of the periphery since not enough sheet is present at the edge of the paddles so that it could reach to the limit of the rear disk or the front ring. The joint of the rear disk with the strip in the area of the paddles is the point that withstands most strain since the rotary thrust of the motor is driven onto the drum in the rear disk.

For the purposes of joining the strip to the rear disk via a paddle, said paddle has connecting straps which are extensions of the sheet at its ends and are curved parallel to the disk toward the outside of the drum and held down by a plate which is riveted to the rear part of the drum or even riveted to one of the arms by means of which the shaft is joined to the drum, the connecting straps and the rear disk being located between the plate and the arm.

SUMMARY OF THE INVENTION

The object of the invention is to obtain a washing machine drum that is more resistant to the force that is generated when the revolutions of said drum increase during spinning in the wash operation.

This object is achieved with a drum for a front-loading laundry washing machine or the like comprising a cylindrical perforated strip for letting through the water flow with at least one paddle, a rear drum closing disk, and means for joining the disk to the strip in the area of the end of the paddle nearest to the disk, the joining means comprising a rear joining support, a stop located opposite the joining support on the other side of the disk, and a pressure means which joins the stop to the rear joining support, with the disk and part of the end of the paddle being located between same, the stop being designed to be concave and its edges being at least in part in contact with the end of the paddle.

With the drum according to the invention, the joint of the strip with the rear disk is more solid and permits the drum to be capable of being rotated with more revolutions in the course of the spinning of the laundry.

The edge of the paddle has connecting straps, which are curved and are located opposite the disk. This enables the end of the paddle to be capable of being gripped more easily by the stop.

The pressure means runs through the stop, the disk, and the rear joining support through an aperture that is implemented in same. As a result, the joint is integrated into the drum.

The pressure means is a cylinder that is riveted at its ends. It preferably runs through said aperture, with the result that a practically plane and undetachable joint is produced. The same effect would be achievable, for example, with a threaded bolt and a nut, with the result that the assembly would be rendered more expensive.

The drum additionally includes a rotary shaft, which is joined to the rear joining support with the aid of an arm. As a result, the force that the motor of the machine exerts on the drum to make it rotate is transmitted direct to the joint of the disk with the strip, with the result that the strain that it withstands is reduced. To bring about more stable rotation, it is preferable for the shaft to be joined to the drum via at least two arms.

In a preferred embodiment, the stop is made of elastic material that bends from its center under pressure from the pressure means, with the result that its ends exert pressure in the contact area with the connecting straps of the end of the paddle. This has the effect that the force that is exerted by the stop on the connecting straps of the end of the paddle is constant and continuous.

The stop is a trapezoid-shaped plate that fits into the space that the paddle leaves free on the outside of the drum and at least two of the sides of the plate are curved and hold down the connecting straps of the paddle in a linear manner, the contact between the plate and the folds of the paddle being exploited as effectively as possible and they being pressed as effectively as possible against the disk toward the rear joining support.

The connecting straps extend under the stop at least over the same distance as that existing between the stop and the paddle so that the force that works on same to separate the strip from the disk is as large as possible.

DESCRIPTION OF THE DRAWINGS

For the purposes of supplementing the following description and to assist in arriving at a better understanding of the characteristics of the invention, a set of drawings is enclosed with the present description on the basis of which the innovations and advantages of the drum for laundry washing machines that is implemented in accordance with the object of the invention are easier to understand.

DETAILED DESCRIPTION OF THE INVENTION

Figure 1:
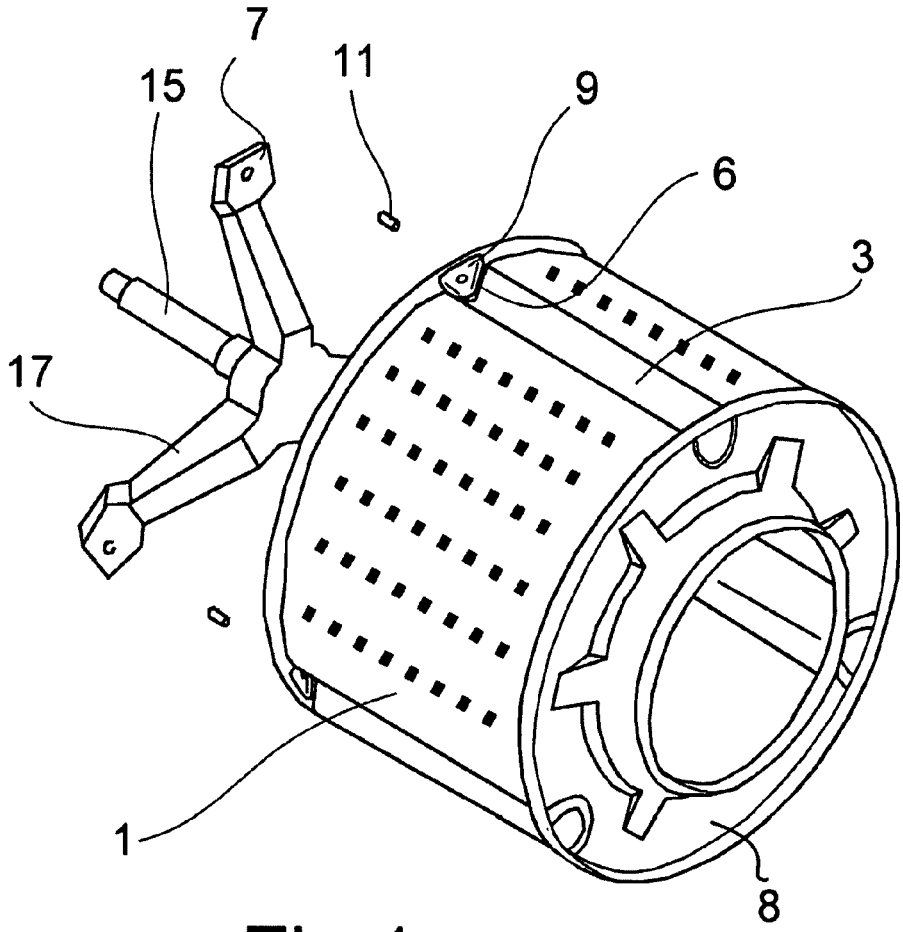
FIG. 1 shows a washing machine drum in an exploded perspective view together with its rotary shaft star and riveting cylinder.

Front-loading washing machines have a washing machine drum such as that in FIG. 1 with a perforated strip 1 and a rotary actuating shaft 15 which is joined with the aid of arms 17 to a rear disk 5 which closes the drum and a front ring 8 which is used for the aperture for the introduction of the laundry to be washed.

This drum is located in the interior of the detergent solution tank, not shown in the figures, which is filled with water and, in this tank, the drum is rotated with the aid of a motor, not shown in the figures, which drives a shaft 15 force-fitted to the drum. The strip 1 forming the drum has apertures scattered on its surface so that the water in the tank can move in and out during the wash cycle.

For the purposes of enhancing the washing performance, the strip 1 forming the drum has deformations 3 which beat the laundry in the course of the rotation during the washing and free it from the internal surface of the strip. These folds are known as paddles 3.

The support 7 for the combining of the strip 1 with the rear disk 5 is joined to the shaft 15 with the aid of an arm 17, with which a star-shaped three-arm unit is formed so that the force that is exerted on the drum in the course of the rotation is distributed.

In the manufacture of drums of this type, the joining of the strip 1 to the rear disk 5 and to the front ring 8 is brought about by the clamping of the metal sheets by folding of said metal sheets.

In the area of the paddles 3, no clamping is achievable as in the rest of the periphery since not enough sheet is present at the edge of the paddles so that it could reach to the limit of the rear disk 5 or the front ring 8. The joint of the rear disk with the strip 1 in the area of the paddles 3 is one of the points that withstand most strain since the rotary thrust of the motor is driven onto the drum in the rear disk.

For the purposes of joining the strip 1 to the rear disk 5 via a paddle 3, said paddle has connecting straps or folds 6 at its end which are nothing other than extensions of the sheet and are curved parallel to the disk 5 toward the outside of the drum.

The folds 6 of the paddle 3 are held down by a metal plate 9 which is riveted to the support 7 by means of a cylindrical rivet 11, the connecting straps and the rear disk being located between same. The support 7 is the end of the arm 17 joined to the rotary shaft 15 of the drum.

The plate 9 is made of elastic material which the rivet 11 runs through by means of an aperture 13, which additionally runs through the disk 5 and the support 7 by means of a corresponding aperture. The plate is designed in such a way that it fits into the gap that the paddle 3 forms with the disk 5, i.e. it is trapezoid-shaped. The plate is flat in its center and the concave shape is produced as a result of the fact that its ends are curved and are located opposite the connecting straps 6 of the paddle 3.

Figure 2:
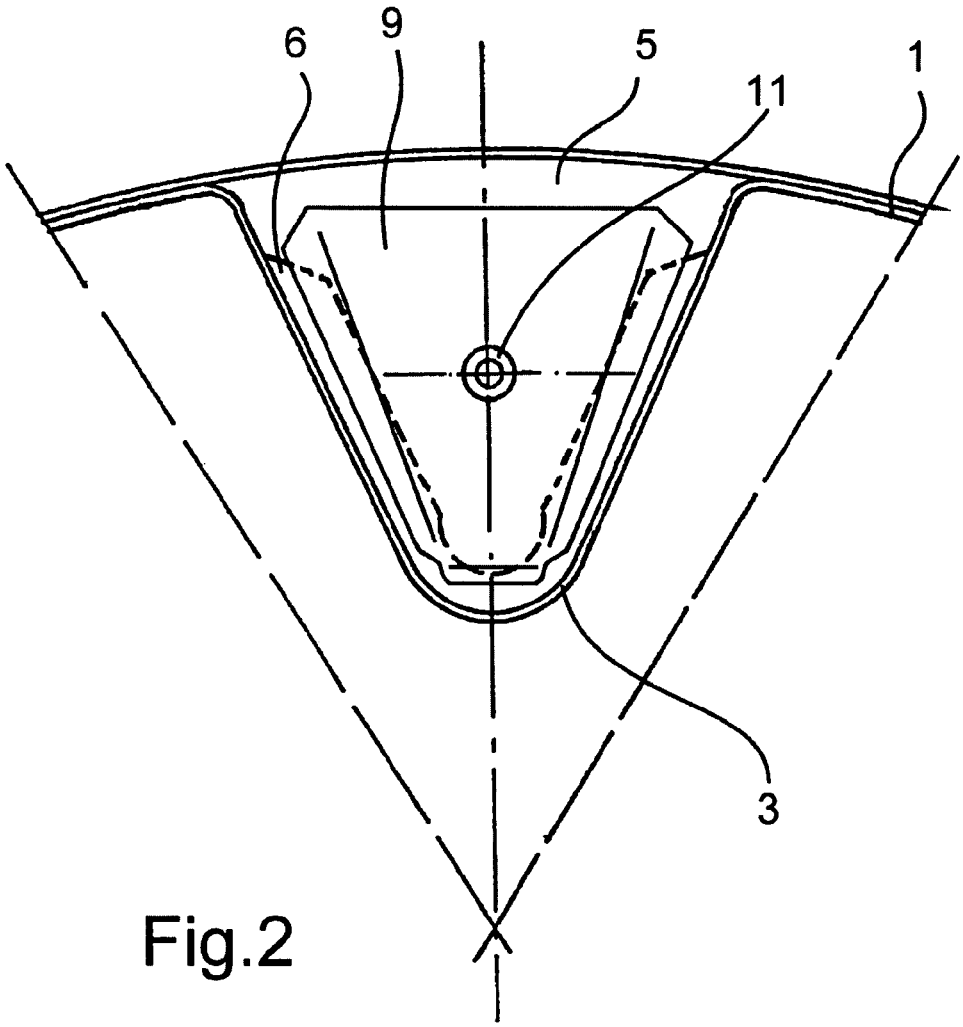
FIG. 2 shows an enlarged plan view of the plate of the joining means for the strip to the rear disk of the washing machine drum in accordance with the invention.
Figure 3:
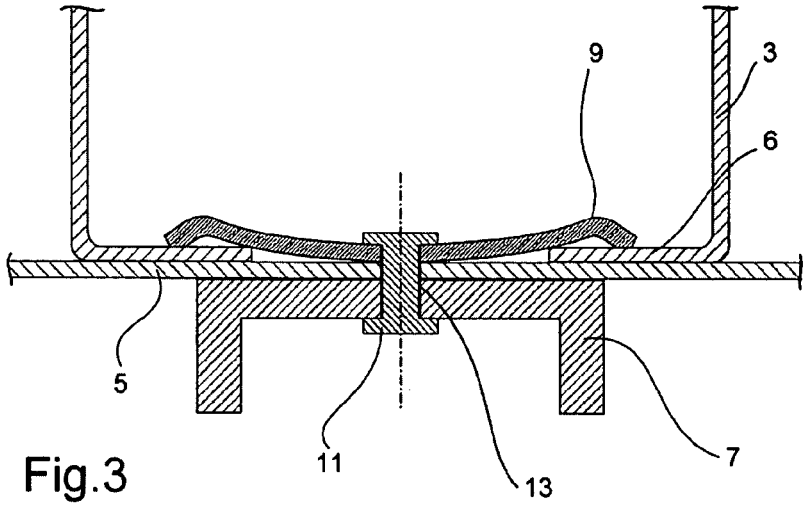
FIG. 3 shows an extract of the joining area of the strip with the rear disk in the area of the paddle.

In the course of the assembly operation, the edges of the plate 9 are supported on the connecting straps 6 of the paddle 3, as can be seen in FIG. 2. The rivet 11 is fed through the hole 13 and riveted, with the result that it exerts a force so that the center of the plate 9 bends and finally makes contact with the disk 5, as is apparent from FIG. 3.

The fact that the sides of the plate are curved toward the connecting straps 6 has the effect that these edges are neither raised up nor detached from the folds as would be the case if the plate 9 were completely plane. Additionally, the edges of the plate 9 hold down the connecting straps 6 of the paddle in a linear manner so that said connecting straps are located underneath same over a sufficient distance so that they withstand the forces generated in the course of the rotation of the drum and are not displaced, i.e. at least the same distance as from the edge of the plate to the paddle 3.

Figure 4:
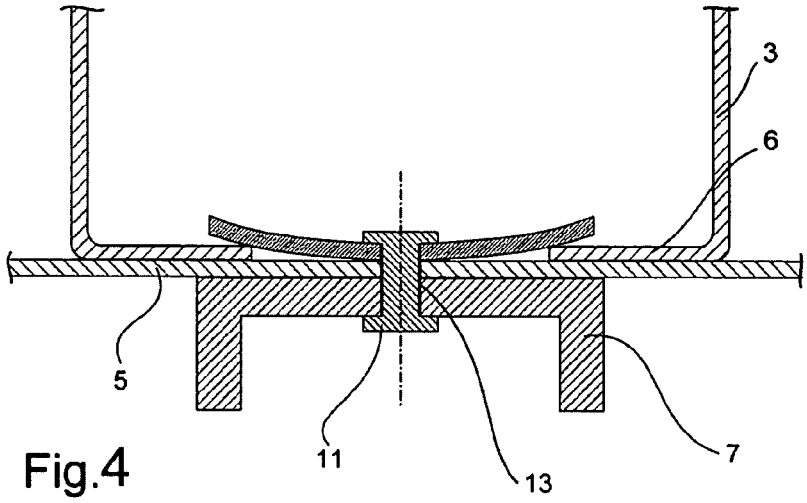
FIG. 4 shows a conventional joining area of a strip with a rear disk in an area of a paddle.

A further advantage that a plate 9 with these characteristics has is that its thickness can be reduced, it becoming cheaper by reducing the material and its performance being improved. A non-concave plate such as that in the prior art has the disadvantage that the pressure exerted in the course of attaching said plate with the cylindrical rivet has the effect that its center presses against the disk 5 and the end of the connecting strap 6 lifts it up by means of leverage and its edges are raised up, as is apparent from FIG. 4.

The invention claimed is:

1. A drum for a front-loading laundry washing machine comprising:

a cylindrical perforated strip permitting water to flow through perforations in the strip and including a paddle;

a rotary shaft;

a rear drum closing disk;

joining means joining the rear drum closing disk to the perforated strip in an area of an end of the paddle adjacent the drum closing disk, the joining means comprising:

a rear joining support coupled to the rotary shaft with an arm;

a stop located opposite the joining support on the other side of the drum closing disk, and a pressure means joining the stop to the rear joining support, the drum closing disk and part of the end of the paddle being located between the stop and the rear joining support, the stop being concave and having edges at least partially contacting the end of the paddle, wherein the paddle includes connecting straps forming the edge of the paddle which are curved and are located opposite the drum closing disk, wherein the stop includes a trapezoid-shaped plate, and wherein at least two of the sides of the plate are curved and hold down the connecting straps of the paddle in a linear manner.

2. The drum as claimed in claim 1, wherein the connecting straps extend under the stop at least over a same distance as that existing between the stop and the paddle.

3. The drum as claimed in claim 1, wherein the stop is made of an elastic material that bends from its center under pressure from the pressure means, with a result that curved ends of the stop exert pressure on the connecting straps of the paddle in a contact area.

4. The drum as claimed in claim 3, wherein the connecting straps extend under the stop at least over a same distance as that existing between the stop and the paddle.

5. The drum as claimed in claim 1, wherein the pressure means runs through the stop, the drum closing disk, and the rear joining support through an aperture positioned in the stop, the drum closing disk, and the rear joining support.

6. The drum as claimed in claim 1, wherein the pressure means includes a cylindrical rivet that is riveted at its ends.

7. The drum as claimed in claim 1, wherein the rotary shaft is coupled to at least two arms.

8. The drum of claim 1, wherein the trapezoid-shaped plate of the stop includes a flat center portion contacting the drum closing disk.

9. The drum of claim 1, wherein the pressure device extends through the rear joining support, the drum closing disk, and a center portion of the stop.

10. A drum for a front-loading laundry washing machine comprising:

a cylindrical perforated strip permitting water to flow through perforations in the strip and including a paddle;

a rotary shaft;

a rear drum closing disk; and a joining device that joins the rear drum closing disk to the cylindrical perforated strip in an area of an end of the paddle adjacent the rear drum closing disk, wherein the paddle includes connecting straps forming an edge of the paddle, wherein the connecting straps are curved and are located opposite the drum closing disk, and wherein the joining device comprises:

a rear joining support coupled to the rotary shaft with an arm;

a stop located opposite the rear joining support on an opposite side of the drum closing disk from the rear joining support; and a pressure device extending through the rear joining support, the drum closing disk, and a center portion of the stop, the pressure device coupling the stop to the rear joining support, wherein the drum closing disk and part of the connecting straps of the paddle are located between the stop and the rear joining support, wherein the stop includes a trapezoid-shaped plate including two curved ends, and wherein each of the two curved ends contacts and holds one of the connecting straps of the paddle against the drum closing disk.

11. The drum of claim 10, wherein the trapezoid-shaped plate of the stop includes a center portion contacting the drum closing disk.

12. The drum of claim 10, wherein the trapezoid-shaped plate of the stop includes a flat center portion contacting the drum closing disk.

13. The drum of claim 10, wherein the pressure device includes a cylindrical rivet that is riveted at each end.

14. The drum of claim 10, wherein the pressure device includes a threaded nut and a bolt secured to the threaded nut.

15. The drum of claim 10, wherein the trapezoid-shaped plate of the stop includes an elastic trapezoid-shaped plate.

16. The drum as claimed in claim 10, wherein each of the rear joining support, the drum closing disk, and the center portion of the stop includes an aperture, and the pressure device extends through the aperture of each of the rear joining support, the drum closing disk, and the center portion of the stop.

* * * * *